United States Patent [19]

Cour

[11] Patent Number: 4,806,049

[45] Date of Patent: Feb. 21, 1989

[54] PROCESS AND DEVICE FOR TEMPORARILY SUPPORTING THE WALLS OF A TRENCH

[75] Inventor: Francis Cour, Maisons-Laffitte, France

[73] Assignee: Geodia, Paris, France

[21] Appl. No.: 36,910

[22] Filed: Apr. 10, 1987

[30] Foreign Application Priority Data

Apr. 14, 1986 [FR] France ..... 8605274

[51] Int. Cl.[4] ..... F16L 1/04

[52] U.S. Cl. ..... 405/161; 405/157

[58] Field of Search ..... 405/154, 157, 159–165, 405/171, 174

[56] References Cited

U.S. PATENT DOCUMENTS 3,699,690 10/1972 Watter ..... 405/157

FOREIGN PATENT DOCUMENTS 0077271 4/1983 European Pat. Off. .

2134567 8/1984 United Kingdom .

*Primary Examiner*—David H. Corbin

*Attorney, Agent, or Firm*—Christel, Bean & Linihan

[57] ABSTRACT

In a trench is disposed a closed flexible envelope filled with a fluid having a density or pressure greater than that of the surrounding fluid, movable by itself under the effect of the pressure exerted at its end by said pipe, which envelope is in the form of a cylinder each end of which has been turned in concentrically to its longitudinal axis, in the direction of the opposite end, the two central portions of this turning in being welded together so as to form a central envelope web turned in along its axis.

9 Claims, 3 Drawing Sheets

PROCESS AND DEVICE FOR TEMPORARILY SUPPORTING THE WALLS OF A TRENCH

BACKGROUND OF THE INVENTION

1. Field of the Invention

The invention which relates to the continuous burial of a pipe in a trench, more particularly in an undersea bed formed of materials having low cohesion, relates to a method and device for temporarily supporting the walls during the trench digging operation.

2. Description of the Prior Art

For protecting pipes, and particularly oil pipe lines, from the harmful effects of undersea currents or swell, as well as for preventing sea anchors or fishing nets from fouling these pipes, efforts have been made for numerous years to bury these pipes in the undersea beds. This has been achieved by disposing these pipes in trenches previously dug in these undersea beds.

This has also been achieved by digging a trench under a pipe previously disposed on the sea bed and which then rests, under the effect of its own weight, by flexion on the bottom of the trench at a certain distance behind the digging devices which are moved along the pipe thereunder.

But although the use and implementation of different devices allow such trenches to be formed and although a pipe can be buried without too much difficulty when the underwater bed has sufficient cohesion for ensuring the stability of the vertical or substantially vertical walls of the trench, the same cannot be said when the undersea bed is sandy, muddy or formed of other powdery materials or materials without sufficient cohesion, for the side walls collapse and the trench fills in, at least partially, before the pipe is suitably positioned on the original bed thereof.

In this latter case, to prevent immediate or substantially immediate filling in of the trench, using different devices a depression or valley of substantial width is formed in the undersea bed, which on the one hand means moving very voluminous amounts of materials and, on the other hand, does not obtain the desired protection for the pipe, except by filling in the depression laterally using the removed materials, which substantially increases the cost of the operation.

One known solution consists then in reinforcing the walls of the trench by means of coffering or formwork which must then be removed and shifted after lowering the pipe, which is a complicated operation.

Another technique consists in fluidifying materials by injecting water under the pipe, which then descends under its own weight.

This delicte technique can however only be used for clean sands.

A new technique used more recently consists in substituting a compressible body of the envelope kind made from a flexible and deformable material for the materials removed from the trench, progressively as this latter advances, so that this body, by its presence or by the pressure which it exerts on the side walls of the trench prevents these latter from collapsing. The reduction of volume of this body is then controlled so as to allow the pipe to be lowered and positioned in the trench and so as to cause collapsing of the side walls and possibly the filling thereof.

According to this method, if required, as the trench advances means are displaced for temporarily holding its side walls in position, preventing collapse thereof before the compressible body has been positioned in the trench.

The flexible and deformable material envelope is brought progressively and continuously into the trench, and is then filled with fluid to a pressure higher than by hydrostatic pressure; by the pressure which it then exerts on the side walls of the trench it prevents the temporary collapsing thereof. The pipe to be buried rests on this envelope usually provided with holes. The progressive reduction of the volume during leaking through the holes of the fluid which it contains cause the pipe to be lowered to the bottom of the trench, thus allowing the side walls thereof to collapse and the pipe to be covered.

This method involves consequently the continuous provision of a flexible and deformable envelope which remains buried under the covering materials and under the pipe after laying thereof and which is therefore lost. Apart from the cost of such an envelope which is therefore to be provided over a length equivalent to that of the pipe, considerable means must also be provided, embarked on a follower ship, for feeding this amount of previously stored envelope, as the digging means advance, and for injecting the pressurized fluid therein when it is resting at the bottom of the trench.

In addition, so that such burial in accordance with this technique takes place under acceptable working conditions, a certain number of precautions must obviously be taken. It is in fact necessary, during the advance of digging of the trench followed by positioning and filling of the flexible envelope, for the pipe to be lowered correctly and progressively with such advance at a certain distance behind the digging zone. In fact, if such lowering were too rapid, there could be an excessive curvature of the pipe under the effect of gravity with a consequent risk of breakage. On the other hand, in some other cases, since the weight of the pipe itself filled with water is insufficient this pipe will descend much too slowly into the trench, the volume of fluid then having to fill the flexible envelope over a greater length; the result is on overconsumption of water through the leak orifices, and great difficulty in regulating the pressure throughout the whole envelope. Since the fluid pressure in said envelope cannot then be correctly regulated, the profile of the pipe can no longer be adjusted and even in some cases the maintenance of a sufficient pressure for preventing collapse of the trench is no longer possible. This problem of regulating the fluid supply pressure of the envelope and the leak rate therefrom through appropriate openings is difficult to overcome, because the continuous flexible envelope has an infinite volume.

The invention brings an efficient solution to these problems for it provides, no longer an open envelope of infinite volume having leak openings, but a closed envelope, of finite volume, whose very design means that it ensures temporary maintenance of the walls of the trench, facilitates lowering into this latter of the pipe to be buried while moving without rubbing against the bottom of the trench, without for all that modifying the mass of the initial fluid contained in the envelope.

SUMMARY OF THE INVENTION

The method of the invention consists in using, in a trench, in replacement of the materials extracted from this latter, a flexible closed envelope movable by itself under the effect of the pressure exerted at its end by the weight of the pipe, because this envelope has a particular structure and shape which allow such advance possibly in combination with complementary advancing means.

According to this method, a structure is sought for this envelope such that the different points of its external wall remain fixed with respect to the trench in which it is placed as well as with respect to the pipe which it supports, whereas its ends are turned on one side inwardly along a longitudinal axis, and opened out on the other side from the inside towards the outside so that the simultaneous contraction and opening out of the envelope along said longitudinal axis cause the assembly to advance which in longitudinal section ressembles two superimposed caterpillar tracks.

The device for implementing this method of the invention consists of an envelope which is in the form of a cylinder each circular end of which has been turned in concentrically with its longitudinal axis, in the direction of the opposite end, the two ends then being welded together so as to form a central envelope web turned in substantially along the longitudinal axis.

BRIEF DESCRIPTION OF THE DRAWINGS

The particular features and advantages of the invention will be clear from reading the following description of embodiments which must be considered as non limitative examples with reference to the accompanying drawings which show.

DESCRIPTION OF THE PREFERRED EMBODIMENT

Figure 1:
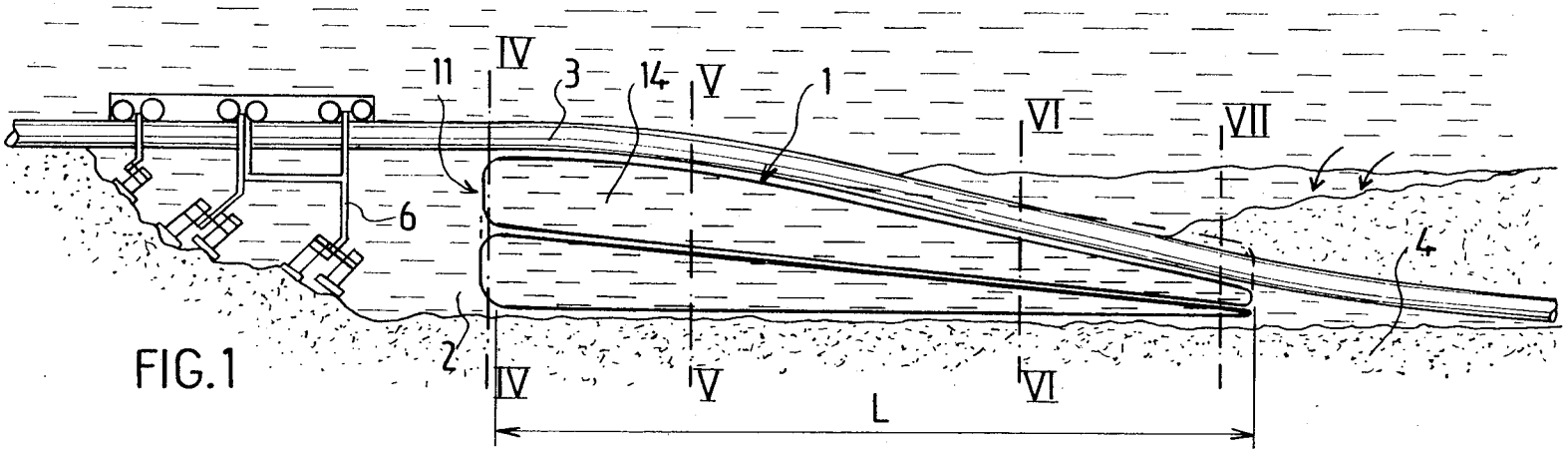
FIG. 1, a schematical view in partial longitudinal section of a trench provided with the device of the invention, FIG. 2, a schematical perspective view of the flexible envelope, FIG. 3, a sectional view through III—III of FIG. 2, FIGS. 4 to 7, sectional views through lines IV—IV to VII—VII of FIG. 1, FIGS. 8 and 9 schematical sectional views of the flexible envelope in two successive advancing phases, FIGS. 10 and 11, two schematical views in cross section of a variant of construction, for two pipe burying phases, and FIG. 12, a schematical sectional view of another variant of the invention.

In FIG. 1 have been shown a mobile device 6 for digging a trench 2 under a pipe 3 previously disposed on an undersea bed 4 of low or medium cohesion.

The digging device used may be one of the mechanical or hydraulic devices of known type which are used at present in association with a device (not shown) for removing the materials extracted during digging of trench 2. The assembly formed by the digging device 6 and the removal device is moved along pipe 3 at the same time as a surface ship moves. A device is provided for temporarily holding the side walls of this trench and is formed by a caisson, coffering or framework, having at least two flat rigid sides, moved parallel with each other and each parallel to a side wall of a trench, or is dragged along the pipe 3 and under this latter with the digging device 6.

An envelope 1 made form a flexible and deformable material, having a length L and a special structure, which is filled with a fluid of a density or pressure possibly greater than that of the water, occupies the internal volume of trench 2, behind the digging devices 6 and replaces the materials released by these devices and removed.

Figure 2:
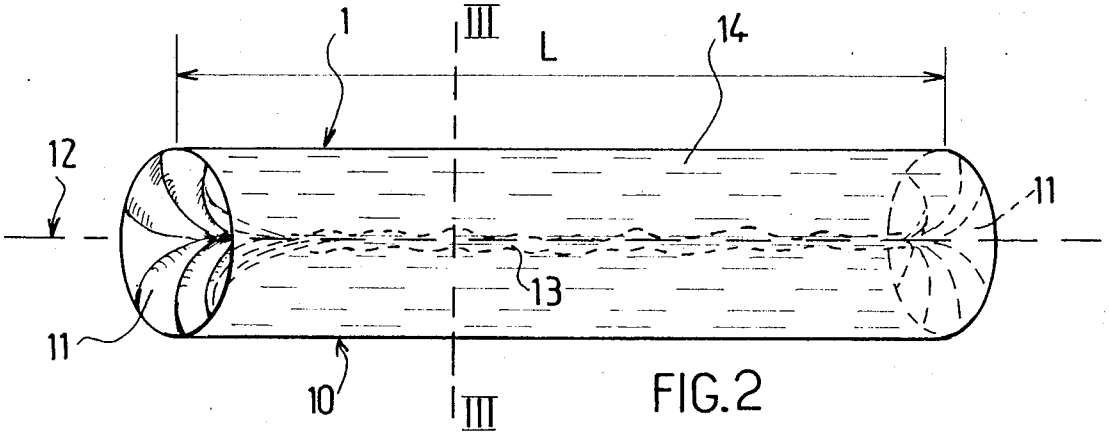
Figure 3:
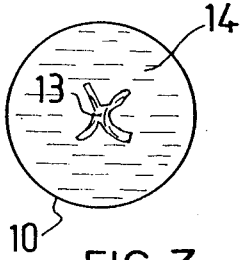
Figure 4:
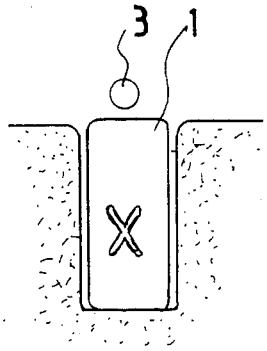
Figure 5:
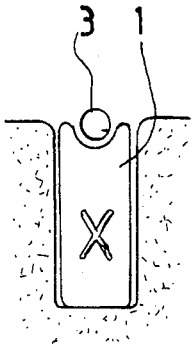
Figure 6:
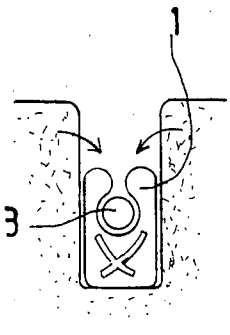
Figure 7:
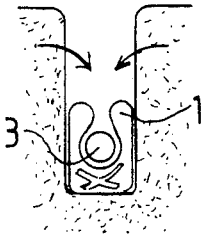

The flexible envelope designated as a whole by the reference 1 would have, outside the trench, the special structure illustrated particularly in FIGS. 2 and 3.

It is manufactured in the form of an elongate cylinder of length L, each end 11 of which is turned in concentrically to its longitudinal axis 12 in the direction of the opposite end, the two ends resulting from this turning in of the outer envelope being welded together so as to from a central turned in envelope web 13 joining, substantially along axis 12, the two ends 11 of the assembly thus formed, which provides a closed and sealed enclosure.

Thus designed and manufactured, the envelope is filled with a fluid 14 whose pressure is at least equal to that of the external medium.

The outer part 10 of the envelope takes on a cylindrical shape. The end sections 11 take on a substantially circular shape. The central internal web 13 formed as was seen by turning in the ends of the envelope 1, being subjected to the overpressure of the fluid 14 contained in said envelope, will therefore be folded on itself and will assume a shape similar to that shown in FIG. 3.

In the particular case of the operations for digging an undersea trench, envelope 1 manufactured as indicated above, stored free of fluid inside two provisional supports is progressively opened out and inflated in the trench behind the digging devices 6 with a fluid of a density or pressure possibly greater than that of water. Thus it occupies the volume of the trench while bearing on the side walls thereof which cannot collapse and on pipe 3 which, because of its weight, rests on the upper part of envelope 1. This latter, as can be seen in FIG. 1, is deformed with respect to the tube in the above described state of equilibrium at rest. In fact, it has adapted itself laterally to the profile of the trench, as can be seen in FIGS. 4 to 7. Furthermore, it is also deformed longitudinally under the action of the weight of pipe 3.

Thus, at a given moment during the advance of the digging devices 6, envelope 1 is progressively crushed between its front part where face 11 has substantially its original circular shape and the rear part almost totally crushed. In the sections of FIGS. 4 to 7, the profile of envelope 1 with respect to pipe 3 can be seen, at different points of the envelope over the whole of its length L. It will be noted more particularly in FIGS. 6 and 7 that the corresponding pipe portion has sunk into the envelope whose side edges, along the trench wall, may receive it at least partially.

Figure 8:
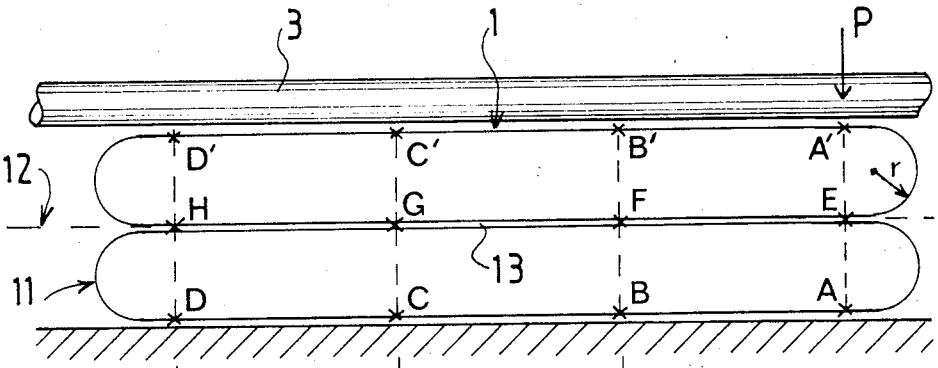

Because of its particular structure, this closed envelope 1, subjected to the weight exerted by pipe 3 on its upper face 10, will move by itself under said pipe, behind the digging member 6. In fact, the external form of envelope 1 shown schematically in FIG. 8 corresponds to an infinity of equilibrium states, which it may have on a horizontal soil when it is filled with a pressurized fluid. In this position shown, a certain number of contact points of the envelope with the ground: A, B, C, D. Vertically above these points A, B, C, D, but on the upper surface of the envelope are shown points A′, B′, C′, D′ which are bearing points of pipe 3.

On the central web 13, that is to say along the axis 12, corresponding points E, F, G, H have been shown.

Figure 9:
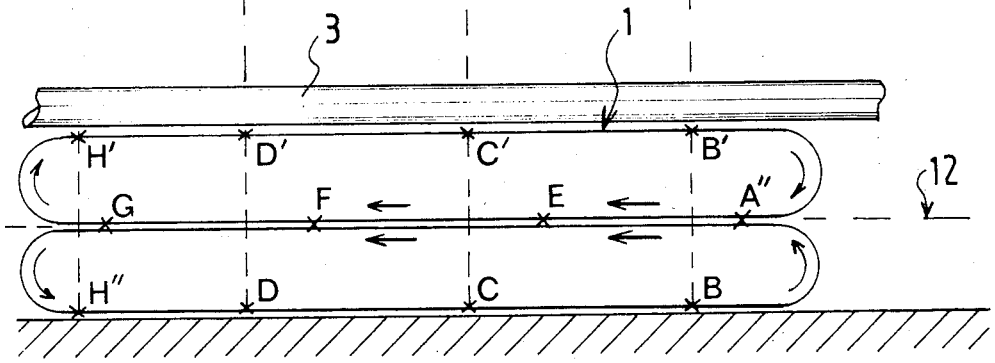

As mentioned above, the ends 11 of the envelope are turned in and have therefore a profile with substantially the shape of two half circles on each side of axis 12. If a vertical pressure P is exerted on the envelope at the level of point A', the radius of curvature R of the end profiles of wall 11 tend to be modified. Since the fluid pressure inside the envelope is constant, the modification of this radius of curvature under the action of the weight of the pipe will cause a breakdown of the state of equilibrium of envelope 1 and will cause movement thereof from the position of equilibrium illustrated in FIG. 8 to the displaced position illustrated in FIG. 9. The points B, C, D and B', C', D' remain fixed with respect to the bottom of the trench and pipe 3. On the other hand, the rear part of the envelope has rolled up in the direction of the small arrows inwardly along axis 12, points A and A'' of the envelope coming to occupy a position A'' where they now form the central web thereof. Simultaneously, the front part of the envelope rolls out from the inside from axis 12, point H now occupying positions H' and H' on the outside of the envelope, forming a new point of contact with the ground and the pipe. The internal points E, F, G have undergone a movement in the direction of the arrows with respect to their initial position. Between these two positions, the envelope has undergone a displacement which can be likened to that of two superimposed belts or caterpillar tracks. With the contact points B, C, D being fixed, advance of the envelope resulting from the inward contraction of its rear part 11 and the outward opening out of its front part, takes place without any rubbing either at the level of pipe 3 or at the level of the walls and the bottom of the trench.

Consequently, as soon as pipe 3 begins to sink on the rear part of the envelope, the imbalance created would cause it to advance; the pipe will then descend progressively into the trench and will finally rest on the bottom after release of the envelope. The trench will be filled in either by natural collapse, or by appropriate means of known type, but this result may also be obtained by the effects of the swell or undersea currents so that said buried pipe is suitably protected.

Figure 10:
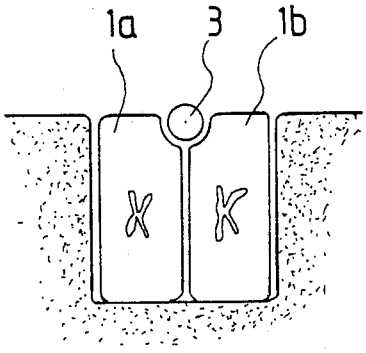
Figure 11:
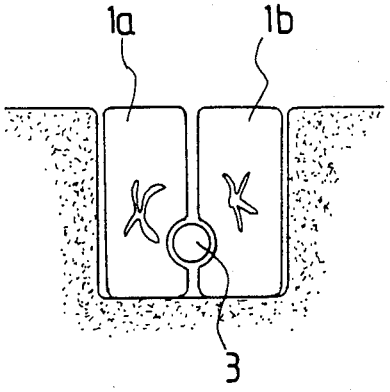

In FIGS. 10 and 11 a variant of construction has been shown using two identical envelopes 1A and 1B placed side by side in a trench. Pipe 3 placed in the middle, that is to say in line with the adjacent side faces of the envelopes rests on both of these envelopes at the same time. when it descends (FIG. 11), it is held between the two side wall of the envelopes firmly applied against each other because of the internal pressure of the fluid which they contain. When the pipe is imprisoned by the envelopes which have closed above it, it floats as it were inside the envelopes which exert thereon an equivalent pressure in all directions. The pipe, under the effect of its own weight, descends all the more readily towards the bottom of the trench.

The advantage of this variant resides in the fact that, over the whole of their length, the outer profile of the envelopes 1A and 1B has not undergone any substantial modifications, which means that at the rear of the burying these two envelopes applied side by side are not crushed by the pipe; thus the risks of jamming are avoided. Moreover, as the envelopes advance which support the side walls of the trench over the whole of its height, and over the whole of their length, these walls are suddenly released and, no longer being supported, collapse on the pipe, thus promoting burial thereof.

Without departing from the scope of the present invention, a plurality of envelopes may be used in the same excavation mounted side by side and intended to support a bundle of parallel pipes.

Figure 12:
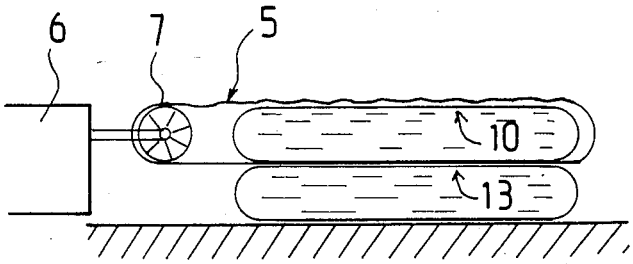

This or these envelopes may be associated with at least one complementary means, not shown, which facilitates their progression as the pipe descends. The envelope may also be drawn behind the digging device by means of a gripping system. Thus jamming or damage of the envelope on uneven undersea beds is avoided. An endless belt 5 may also be used, as shown in FIG. 12, one run of which would be nipped inside envelope 1 along its central web 13 and the opposite run of which (passing above the envelope in the example shown) rests on the outer wall 10 of the envelope. This belt is hitched to the digging member 6 by means of a pulley 7 over which it is stretched. The part of this belt 5 situated in web 13 of the envelope, subjected to the tractive force exerted by the digging device 6 transmits this tractive force by friction to envelope 1 and thus promotes displacement thereof.

One or more similar belts may be provided about the envelope.

Of course, the fluid filled envelope must be both resistant and flexible to pass rapidly and continually from a stretched position on the outside to a turned in and compressed position when it forms the web 13, and this without any risk of tearing. This assembly, working in sand loaded waters, remains nevertheless very reliable, particles being entrained, during progression of the envelope, along the central web 13 and released at the front of the trench, without adversely affecting the operation of the assembly.

What is claimed is:

1. In a method for temporarily supporting the walls of a trench following digging thereof in a soil, particularly an undersea bed formed of materials having low cohesion, for burying a pipe such as an oil pipeline, characterized by providing at least one means for temporarily holding the walls, formed of a closed envelope of constant predetermined length, made from a flexible and deformable material filled with a fluid at a pressure greater than the hydrostatic pressure, utilizing said means to take the place of the materials extracted from the trench as the trench advances, on which envelope the pipe rests during descent of the pipe to the bottom of the trench, and giving said envelope a structure such that the points of the outer wall of said envelope remain fixed with respect to the trench in which said envelope is placed as well as with respect to the pipe which said envelope supports, whereas the ends of said envelope are turend in on one side along a longitudinal axis and open out on the other side from the inside to the outside so that the simultaneous contraction and opening out of the envelope along said longitudinal axis ensure that advance of the assembly in the manner of two superimposed caterpillar tracks, under the action of the weight exerted by the pipe, combined eventually with complementary means promoting the advance.

2. The method as claimed in claim 1 including providing a digging means and disposing in the trench behind the digging means at least one said envelope at least partially filled with a fluid having a pressure or a density greater than that of the surrounding fluid.

3. The method as claimed in claim 1, wherein said complementary means promoting the advance of the envelope is formed of a member connected to the envelope and hitches to a digging means.

4. A device for temporarily supporting the walls of a trench following digging thereof in a soil, particularly an undersea bed formed of materials having low cohesion, for burying a pipe such as an oil pipeline, said device comprising at least one means for temporarily holding the walls, formed of a closed envelope of constant predetermined length, made from a flexible and deformable material filled with a fluid at a pressure greater than the hydrostatic pressure for taking the place of the materials extracted from the trench as the trench advances, on which envelope the pipe rests during descent of the pipe to the bottom of the trench, said envelope having a structure such that the points of the outer wall of said envelope remain fixed with respect to the trench in which said envelope is placed as well as with respect to the pipe which said envelope supports, whereas the ends of said envelope are turned in on one side along a longitudinal axis and open out on the other side from the inside to the outside so that the simultaneous contraction and opening out of the envelope along said longitudinal axis ensure the advance of the assembly in the manner of two superimposed caterpillar tracks, under the action of the weight exerted by the pipe, combined eventually with complementary means for promoting the advance.

5. The device as claimed in claim 4 wherein said closed envelope filled with fluid has an axis and is placed in the trench behind digging members and is in the form of a cylinder having a longitudinal axis each circular end of said cylinder having been turned in concentrically to said longitudinal axis in the direction of the opposite one of said ends the two ends resulting from such turning in being welded to one another so as to form a central turned in envelope web substantially along the axis of the envelope.

6. The device as claimed in claim 5, wherein the ends of said envelope have a rounded profile between the outer face and the central web, with a radius of curvature, and at least one end of said envelope is subjected to a pressure exerted by the pipe which modifies said radius of curvature in the direction of advance of the envelope.

7. The device as claimed in claim 5, wherein at least two closed envelopes are disposed side by side in the same trench and receive a pipe in line with adjacent lateral faces of said envelopes.

8. The device as claimed in claim 5, wherein said complementary means promoting the advance is a mechanical traction means adapted to be hitched to said digging members.

9. The device as claimed in claim 8, wherein said complementary means is formed of at least one endless belt one run of which is nipped inside the envelope along the central web of said envelope.

* * * * *